US008097098B2

(12) United States Patent
Montagnon

(10) Patent No.: US 8,097,098 B2
(45) Date of Patent: Jan. 17, 2012

(54) MARTENSITIC STAINLESS STEEL COMPOSITION, METHOD FOR MAKING A MECHANICAL PART FROM SAID STEEL AND RESULTING PART

(75) Inventor: Jacques Montagnon, La Varenne St Hilaire (FR)

(73) Assignee: Aubert & Duval, Paris (FR)

( * ) Notice: Subject to any disclaimer, the term of this patent is extended or adjusted under 35 U.S.C. 154(b) by 567 days.

(21) Appl. No.: 11/993,675

(22) PCT Filed: Jun. 26, 2006

(86) PCT No.: PCT/FR2006/001472

§ 371 (c)(1),
(2), (4) Date: Oct. 28, 2008

(87) PCT Pub. No.: WO2007/003748

PCT Pub. Date: Jan. 11, 2007

(65) Prior Publication Data

US 2010/0139817 A1 Jun. 10, 2010

(30) Foreign Application Priority Data

Jun. 28, 2005 (FR) ..... 05 06591

(51) Int. Cl.

| | |
|---|---|
| ***C22C 38/44*** | (2006.01) |
| ***C22C 38/50*** | (2006.01) |
| ***C21D 6/04*** | (2006.01) |
| ***C21D 8/00*** | (2006.01) |

(52) U.S. Cl. ..... 148/327; 148/326; 148/578; 148/607; 148/608; 148/609; 148/610; 420/53

(58) Field of Classification Search ..... 148/326, 148/327, 578, 607–610; 420/53
See application file for complete search history.

(56) References Cited

U.S. PATENT DOCUMENTS

| | | | | | |
|---|---|---|---|---|---|
| 2,958,617 | A | * | 11/1960 | Perry | 148/578 |
| 2,958,618 | A | * | 11/1960 | Allen | 148/578 |
| 3,151,978 | A | * | 10/1964 | Perry et al. | 420/46 |
| 3,314,831 | A | * | 4/1967 | Hoenie et al. | 148/578 |
| 3,342,590 | A | | 9/1967 | Bieber | |
| 3,347,663 | A | * | 10/1967 | Bieber | 420/49 |
| 3,556,776 | A | | 1/1971 | Clarke, Jr. et al. | |
| 6,238,455 | B1 | | 5/2001 | Brown et al. | |
| 6,537,396 | B1 | * | 3/2003 | Ijames | 148/578 |

FOREIGN PATENT DOCUMENTS

| | | | | |
|---|---|---|---|---|
| FR | 1 399 973 | A | | 5/1965 |
| FR | 1399973 | | * | 5/1965 |
| GB | 988 452 | A | | 4/1965 |
| GB | 1221584 | A | | 2/1971 |
| JP | 02 310339 | A | | 12/1990 |
| JP | 02-3103339 | | * | 12/1990 |
| WO | WO 2004/106559 | A | | 12/2004 |

* cited by examiner

*Primary Examiner* — Deborah Yee
(74) *Attorney, Agent, or Firm* — Sughrue Mion, PLLC

(57) ABSTRACT

The invention concerns martensitic stainless steel, characterized in that its composition in weight percentages is as follows: 9%=Cr=13%; 1.5%=Mo=3%; 8%=Ni=14%; 1%=Al=2%; 0.5%=Ti=1.5% with AI+Ti=2.25%; traces=Co=2%; traces=W=1% with Mo+(W/2)=3%; traces=P=0.02%; traces=S=0.0050%; traces=N=0.0060%; traces=C=0.025%; traces=Cu=0.5%; traces=Mn=3%; traces=Si=0.25%; traces=O=0.0050%; and is such that: Ms (° C.)=1302 42 Cr 63 Ni 30 Mo+20AI-15W-33Mn-28Si-30Cu-13Co+10 Ti=50Cr eq/Ni eq=1.05 with Cr eq (%)=Cr+2Si+Mo+1.5 Ti+5.5 AI+0.6W Ni eq (%)=2Ni+0.5 Mn+3O C+25 N+Co+0.3 Cu. The invention also concerns a method for making a mechanical part using said steel, and the resulting part.

26 Claims, No Drawings

MARTENSITIC STAINLESS STEEL COMPOSITION, METHOD FOR MAKING A MECHANICAL PART FROM SAID STEEL AND RESULTING PART

The present invention relates to a martensitic stainless steel, and in particular an alloyed steel containing principally the elements chromium, nickel, molybdenum and/or tungsten, titanium, aluminium and possibly manganese, and proposing a unique combination of increased resistance to corrosion and mechanical strength.

For certain critical applications where the mechanical parts made from steel are subjected to very substantial stresses and for which the mass of these parts is a major factor, for example in the fields of aeronautics (landing gear casings) or of space, martensitic steels will be used which have a very high mechanical strength and, in addition, offer good toughness as measured by the sudden breaking test $K_{1C}$.

Slightly alloyed martensitic carbon steels (that is to say steels in which none of the alloy elements exceeds 5% by mass), quenched and annealed, are suitable the majority of the time when operating temperatures remain below their annealing temperature.

Amongst these steels, those alloyed with silicon can withstand slightly higher operating temperatures because their annealing temperature in order to obtain the best compromise between the resistance to breaking ($R_m$) and the toughness ($K_{1C}$) is typically situated towards 250/300° C.

When the operating temperatures intermittently or permanently exceed these values, use must be made of "maraging" steels (martensitic low-carbon hardened by precipitation of intermetallic elements), of which the annealing is effected at 450° C. or above as a function of the required compromise $R_m/K_{1C}$.

Compromises $R_m/K_{1C}$ of the order of 1900 MPa/70 MPa $\sqrt{m}$ and 2000 MPa/60 MPa$\sqrt{m}$, where m is expressed in metres, are currently obtained with these categories of steels, by means of appropriate production which is nowadays controlled by known industrial means.

These classes of steels are extremely sensitive to what is currently called "stress corrosion", but which is in fact one of the forms of external hydrogen embrittlement produced by superficial corrosion reactions (pitting, intergranular corrosion in particular). The crack propagation threshold in these steels in the presence of corrosion reactions ($K_{1CSC}$) is very much lower than their value of $K_{1C}$; for slightly alloyed steels treated above 1600 MPa of Rm, the value of $K_{1CSC}$ exhibits a minimum value between the ambient temperature and 80° C. which is of the order of 20 MPa$\sqrt{m}$ in aqueous media with a low chloride concentration. The breaking pattern is typically intergranular in probable relation to trapping and accumulation of hydrogen above the critical concentration on the intergranular carbides $\epsilon$ or $Fe_3C$ formed during annealing.

The sensitivity of non-stainless maraging steels, although less marked than in less alloyed steels because the diffusion of hydrogen in their very alloyed matrix is less and the ways of trapping the hydrogen are apparently less harmful, also remains very high at temperatures of the order of 20 to 100° C. which correspond to phases of operational use.

Hitherto, the only means of protection against these very damaging phenomena was to protect surfaces by anticorrosion coatings such as cadmium plating, which is much used in aeronautics. However, these coatings cause considerable problems.

In fact these coatings are subject to chipping and to cracking, which necessitates regular and attentive checking of condition of the surface.

Furthermore, cadmium is an element which is very harmful to the environment, and its use is strictly controlled by certain regulations.

Moreover, the different chemical or electrolytic coating operations release hydrogen which is capable of irreparably damaging the parts to be protected by the well-known phenomenon of "delayed fracture" or "static fatigue" before they are put into operation, and the methods of prevention are very cumbersome and expensive.

In all cases, the solid substrate remains intrinsically very sensitive to the brittle cracking encouraged by external hydrogen from any source whatsoever.

Currently, there is no slightly alloyed steel with a very high resistance ($R_m$>1900 MPa) which exhibits a value of $K_{1CSC}$ in atmospheric or urban environments which would come close to the value of $K_{1C}$ measured in a neutral atmosphere, and a detailed study of the mechanisms of crack propagation in the presence of internal or external hydrogen would tend to prove that the ratios $K_{1CSC}/K_{1C}$ of present-day very high-strength steels are always very clearly less than one, except in the case where elements of the class of platinoids are introduced into these steels. These elements act as a hydrogen "repellent", but their prohibitive cost nowadays precludes their use as addition elements.

Moreover, maraging steels also exist which have high chromium contents (>10% Cr) and are considered stainless in "urban" atmospheres; a representative example of steel of this category is described in the document U.S. Pat. No. 3,556,776.

However, none of these maraging stainless steels which are currently known make it possible to achieve the levels of mechanical strength which are offered by maraging steels without chromium and slightly alloyed steels, namely a resistance to traction Rm of 1900 MPa and more.

The object of the steel composition according to the invention is to solve these technical problems by proposing a martensitic stainless steel, having an intrinsic resistance to corrosion in an atmospheric medium (marine or urban environment) for which the external hydrogen source is eradicated, and simultaneously exhibiting a high resistance to traction (of the order of 1800 MPa and above) and a toughness equivalent to that of slightly alloyed carbon steels with very high strength.

To this end, the invention relates to a martensitic stainless steel, characterised in that its composition is, in percentages by weight:

9%≦Cr≦13%
1.5%≦Mo≦3%
8%≦Ni≦14%
1%≦Al≦2%
0.5%≦Ti≦1.5% with Al+Ti≧2.25%
traces≦Co≦2%
traces≦W≦1% with Mo+(W/2)≦3%
traces≦P≦0.02%
traces≦S≦0.0050%
traces≦N≦0.0060%
traces≦C≦0.025%
traces≦Cu≦0.5%
traces≦Mn≦3%
traces≦Si≦0.25%
traces≦O≦0.0050% and is such that:

$$M_S(°\,C.)=1302-42Cr-63Ni-30Mo+20Al-15W-33Mn-28Si-30Cu-13Co+10Ti\geqq 50$$

$$Cr\ eq/Ni\ eq\leqq 1.05$$

with Cr eq (%)=Cr+2Si+Mo+1.5Ti+5.5Al+0.6W

Ni eq (%)=2Ni+0.5Mn+30C+25N+Co+0.3Cu

Preferably 10%≦Cr≦11.75%.
Preferably 2%≦Mo≦3%.
Preferably 10.5%≦Ni≦12.5%.
Preferably 1.2%≦Al≦1.6%.
Preferably 0.75%≦Ti≦1.25%
Preferably traces≦Co≦0.5%
Preferably traces≦P≦0.01%
Preferably traces≦S≦0.0010%
Preferably traces≦S≦0.0005%
Preferably traces≦N≦0.0030%
Preferably traces≦C≦0.0120%
Preferably traces≦Cu≦0.25%
Preferably traces≦Si≦0.25%
Preferably traces≦Si≦0.10%
Preferably traces≦Mn≦0.25%
Preferably traces≦Mn≦0.10%
Preferably traces≦O≦0.0020%.

The invention also relates to a method of making a mechanical part from steel with high mechanical strength and resistance to corrosion, characterised in that:

- a semi-finished product is produced by preparation then transformation whilst hot of an ingot having a composition as described above;
- a heat treatment is carried out of melting the said semi-finished product between 850 and 950° C., immediately followed by a cryogenic treatment of rapid cooling to a temperature below or equal to −75° C. without interruption below the point of transformation Ms and during a sufficient time in order to ensure complete cooling throughout the thickness of the part;
- annealing is carried out by ageing between 450 and 600° C. for an isothermal maintenance period of 4 to 32 hours.

The said cryogenic treatment can be quenching with dry ice.

The said cryogenic treatment can be carried out at a temperature of −80° C. for at least 4 hours.

Between the said melting treatment and the said cryogenic treatment, isothermal quenching can be carried out at a temperature higher than the point of transformation Ms.

After the cryogenic treatment and before the ageing annealing, cold shaping and a thermal melting treatment are carried out.

At least one thermal treatment of homogenisation is carried out between 1200 and 1300° C. for at least 24 hours on the ingot or during its transformations while hot into a semi-finished product, but before the last of these hot transformations.

The invention also relates to a mechanical part made from steel with high resistance to corrosion and high mechanical strength, characterised in that it has been obtained by the preceding method.

It may for example be a casing of an aircraft landing gear.

As will be understood, the invention is based in the first instance on a steel composition as defined above. In particular it has as special features Ni, Al, Ti, Mo, Cr and Mn contents which are or may be quite high.

Thermomechanical treatments are also proposed by which the desired properties for the final metal are obtained.

The steel according to the invention enables structural hardening by simultaneous precipitation of the secondary phases of type β-NiAl, η-$Ni_3Ti$ and possibly μ-$Fe_7(Mo, W)_6$ according to the effect known as "maraging" which, after thermal ageing which ensures the precipitation, gives it a very high level of mechanical strength of at least 1800 MPa, combined with a good resistance to corrosion, in particular to corrosion under stress in atmospheric corrosive environments.

Its fatigue resistance is also improved by means of the strict control of impurities known to be harmful (nitrogen, oxygen).

Moreover, the steel according to the invention has a good resistance to heating and can therefore withstand temperatures which reach 300° C. for short periods and of the order of 250° C. for long periods. Its sensitivity to hydrogen is lower than that of the slightly alloyed steels.

The invention will be better understood by reading the following description.

Steels with very high resistance are very sensitive to corrosion under tension. The steel composition according to the invention is such that the actual origin of the rupture by corrosion under tension, which is the production of hydrogen by mechanisms of corrosion then the embrittlement of the metal by internal diffusion of this hydrogen, is circumvented in atmospheric environments by virtue of an enhanced resistance to corrosion in general. To this end, the chromium and molybdenum contents are at least respectively 9% and 1.5%, preferably at least 10% and 2%, in such a way in this latter case as to achieve a pitting index I.P., defined by I.P.=Cr+3.3 Mo, of at least 16.5, like that of the austenitic stainless steels of the type AISI 304 at 16-18% Cr. In fact, a minimum chromium content of 9 to 11% is necessary in order to give a steel a capacity for protection against corrosion in a humid atmosphere, by virtue of the formation on its surface of a chromium-rich oxide film. However, this protective film is insufficient in the case where the atmospheric environment is polluted by sulphate or chloride ions which can develop corrosion by pitting then by splitting, both capable of supplying embrittling hydrogen.

The element molybdenum itself has a very favourable effect on the reinforcement of the passive film with respect to corrosion in aqueous media polluted by chlorides or sulphates.

Secondly, the effect of hardening which imparts a very high mechanical strength to steel is obtained by precipitation of a plurality of secondary hardening phases during an annealing heat treatment of an entirely martensitic structure. This martensitic structure prior to the annealing results from a prior melting treatment in the austenitic range, then cooling (or quenching) to a temperature which is sufficiently low for all of the austenite to be transformed into martensite.

The steel according to the invention undergoes this hardening by virtue of the precipitation of intermetallic prototype phases β-NiAl, η-$Ni_3Ti$ and possibly μ-$Fe_7$ (Mo, W)$_6$. The strongest hardening is obtained with the highest additions of aluminium, titanium and molybdenum. The nickel content must be very precisely adjusted in such a way that the maximum hardening is obtained on the basis of a purely martensitic structure, without ferrite or residual austenite from quenching.

Thirdly, the steel according to the invention has maximum ductility and toughness, which are obtained in particular by limiting at best the effects of anisotropy linked to the solidification of the ingots.

To this end, the steel must be free of the ferrite phase δ and the residual austenite phase after melting and cooling.

This is the reason why the steel according to the invention is characterised by specific balancing of its addition elements as is described below.

δ ferrite:

This phase is detrimental for two major reasons:

i)—it causes embrittlement of the metal, ii)—it modifies the response to the hardening of the steel and no longer enables it to achieve its optimum mechanical properties.

The steel according to the invention does not contain any ferrite due to the fact that its composition satisfies the conditions described below.

The formulae which will be quoted are based on two relationships between the alloy elements, one being a weighted sum of the contents in % by mass of the elements which stabilise the ferrite, and expressed by a variable Cr equivalent (Cr eq), the other being a weighted sum of the contents in % by mass of the elements which stabilise the austenite, and expressed by the variable Ni equivalent (Ni eq)

$$\text{Cr eq}=\text{Cr}+2\text{Si}+\text{Mo}+1.5\text{Ti}+5.5\text{Al}+0.6\text{W}$$

$$\text{Ni eq}=2\text{Ni}+0.5\text{Mn}+30\text{C}+25\text{N}+\text{Co}+0.3\text{Cu}$$

It is shown that the δ ferrite formed transiently during the solidification of the steel according to the invention can be totally resorbed during a thermal treatment at high temperature and in solid phase, for example between 1200 and 1300° C., when:

$$\text{Cr eq}/\text{Ni eq}\leqq 1.05$$

Chemical Segregation Upon Solidification:

The chemical segregation of a steel during its solidification is an inevitable phenomenon which results from the sharing of the elements between the solid fraction and the liquid fraction around the solid. At the end of solidification, the residual liquid congeals in zones which are conventionally either intergranular or interdendritic, and in these zones an enrichment with certain alloy elements is observed, and/or an impoverishment of other alloy elements. The segregation cells thus formed are then deformed and partially rehomogenised during the thermomechanical transformation operations. After these deformation operations, a so-called "band" structure remains in the direction of the deformation which is clearly anisotropic. The response to the thermal treatments of these segregated bands is very differentiated, which leads to unequal mechanical properties as a function of the direction of the forces exerted: in a quasi-generalised manner the properties of ductility and of toughness ($K_{1C}$) are lessened in all cases where the forces are exerted more or less perpendicular to the band structure.

The structural homogeneity of the steel according to the invention, which is therefore dictated by the solidification conditions, is preferably optimised with the aid of thermal homogenisation treatments at very high temperatures, between 1200 and 1300° C., lasting more than 24 hours, carried out on the ingots and/or the intermediate products, that is to say on the semi-finished products in the course of hot transformation. However, such a treatment must not take place after the last hot transformation, otherwise the grain size will be too large before the rest of the treatments.

Martensitic and Residual Austenite Transformation:

The best properties of the steel according to the invention are obtained following melting between 850 and 950° C., in the austenitic range, followed by sufficiently energetic cooling to enable the total transformation of the austenite into martensite. This transformation must be total for two reasons.

In the first place, the hardening by precipitation of the intermetallic phases during the subsequent ageing only takes place on the basis of the martensitic structure. Thus all the areas of residual austenite which are not transformed after the end of the cooling do not respond to the hardening. This is very detrimental to the overall properties of the steel according to the invention, all the more so as these areas are very often those which result from the residual segregation of the ingots and are therefore highly anisotropic.

Secondly, the best compromises between resistance, ductility and toughness of the steel are obtained when the ageing annealing enables the simultaneous formation of the hardening precipitates and of a small fraction of reverted austenite disposed in films in the defects of the structure such as the inter-lath joints of the martensite. The sandwich structure formed by the martensite laths separated by films of reverted austenite gives the hardened steel a high ductility. In order that a small quantity of this reverted austenite can form from the martensitic structure, it is imperative that this latter should be martensitic, that is to say as free as possible of untransformed residual austenite at the end of the cooling since the melting cycle. In fact, at a given ageing temperature there is only one austenite content at equilibrium, which may be of the residual or the reverted type, the latter being desired.

It is commonly accepted that the width of the range of the martensitic transformation of a very alloyed steel, this range being between the starting temperature of transformation Ms and the finishing temperature of transformation Mf, is approximately 150° C., and that this range is wider as the structure of the steel is less homogeneous. This means that the temperature Ms of a steel which is cooled to ambient temperature (approximately 25° C.) from its melting austenitic range, must be at least 175° C.

Modern technologies easily make it possible to cool steels to temperatures below the ambient temperature (so-called "cryogenic" treatments) which makes it possible to achieve the martensitic transformation of steels in which the temperature Ms is lower than 175° C.; however, there is a limit to this in the sense where this thermally activated phase transformation is substantially impeded at very low temperatures.

The steel according to the invention has a balanced composition in such a way that the transformation temperature Ms is ≧50° C., and preferably close to or higher than 70° C. Thus cooling thereof to −80° C., or lower, in a refrigerant environment, enables the transformation of austenite into martensite. This is made possible by finding a temperature range Ms-Mf of at least 140° C., preferably at least 160° C., by the application, after the melting treatment between 850 and 950° C., of cooling carried out for example in dry ice at −80° C. or lower, for a sufficient period of time to ensure complete cooling of the products and complete transformation of the austenite into martensite.

In order to obtain this effect, the steel according to the invention must have a repetitive and reliable value of Ms which must comply with the following relation, a function of all the addition elements which are included in the steel and have an influence in particular on Ms, including the elements present in residual contents but of which the effect on the value of Ms is strong. This value is calculated by the formula (the contents of the different elements are in % by weight):

$$\text{Ms}(^\circ\text{C.})=1302-42\text{Cr}-63\text{Ni}-30\text{Mo}+20\text{Al}-15\text{W}-33\text{Mn}-28\text{Si}-30\text{Cu}-13\text{Co}+10\text{Ti}.$$

Statistical analysis of experimental castings has enabled validation of this relation for values of Ms from 0 to 225° C. and deduction of the minimum value which the point Ms should have for the steel according to the invention. This value is +50° C. and preferably +70° C.

The roles of the principal addition elements are detailed below:

Chromium and molybdenum are elements which give the steel its good resistance to corrosion: moreover, molybdenum is also capable of participating in the hardening during the precipitation to annealing of the intermetallic phase of the type $Fe_7Mo_6$.

The chromium content of the steels according to the invention is between 9 and 13%, preferably between 10 and 11.75%. Above 13% of chromium, overall balancing of the steel is no longer possible. In fact, by reducing the elements which favour the residual delta ferrite (Mo=1.5%, Al=1.5% and Ti=0.75%, Ti+Al=2.25%) the relation linking Cr eq and Ni eq implies that the nickel content is at least 11%. Such a composition, which is therefore situated at the limit of the ranges according to the invention no longer complies with the relation Ms≧50° C.

This is all the more true as the contents of hardening elements Al, Ti and Mo become higher, hence the preferred upper limit of chromium of 11.75%.

The molybdenum content is at least 1.5% so that it is possible to obtain the desired anti-corrosion effect. The maximum content is 3%. Above 3% of molybdenum, the solvus temperature of an intermetallic phase rich in molybdenum of type x, stable at high temperature, becomes higher than 950° C.; Moreover, in certain cases the solidification is achieved by a eutectic system which produces solid intermetallic phases which are rich in molybdenum and of which the subsequent melting requires melting temperatures higher than 950° C.

In these two cases, austenisation temperatures higher than 950° C. lead to an exaggerated enlargement of the granular structure which is incompatible with the required mechanical properties.

However, if the steel also contains tungsten, this will be partially substituted for molybdenum at a rate of one atom of tungsten for two atoms of molybdenum. In this case the maximum limit of 3% applies to the sum Mo+(W/2).

As has been said, the chromium and molybdenum contents should preferably make it possible to obtain a pitting index of at least 16.5.

Nickel is indispensable to the steel in order to carry out three essential functions:

- to stabilise the austenitic phase at the melting temperatures and to eliminate all trace of δ ferrite; to this end the steel according to the invention must include at least 10% nickel and preferably at least 10.5%, unless another gammagene element is added to the steel, for example manganese; for an addition of manganese up to 3% the nickel content can be reduced to 8%;
- to favour the ductility of the steel, in particular for ageing at temperatures higher than or equal to 500° C., because in this case it causes the formation of a small fraction of so-called reverted austenite which is very ductile and finely dispersed in all the steel between the laths of hard and fragile martensite; however, this ductile effect is obtained to the detriment of the value of the mechanical strength;
- to participate directly in the hardening of the steel during ageing by precipitation of the phases: β-Ni Al and $\eta$-$Ni_3Ti$.

The austenite content dispersed in the steel must be limited to 10% maximum in order to retain very high mechanical strengths: the nickel content is, in this perspective, a maximum of 14%; the preferred content thereof between 10.5 and 12.5% is finally adjusted precisely with the aid of the two relations described previously: Cr eq/Ni eq≦1.05; $M_s$≧50° C.

Aluminium is an element which is necessary to the hardening of steel; the maximum levels of resistance required (Rm≧1800MPa) are only attained with an addition of at least 1% aluminium, and preferably at least 1.2%. The aluminium strongly stabilises the δ ferrite and the steel according to the invention cannot contain more than 2% aluminium without the appearance of this phase. Thus the aluminium content is preferably limited to 1.6% as a precaution so as to take account of the analytical variations of the other elements which favour ferrite, and which are principally chromium, molybdenum and titanium.

Titanium, like aluminium, is an element which is necessary for the hardening of the steel. It enables hardening thereof by precipitation of the phase $\eta$-$Ni_3Ti$.

In maraging steel of the type PM 13-8Mo and containing more than 1% Al, the increase in the mechanical strength value Rm produced by the titanium is approximately 400 MPa per percentage of titanium.

In the steel according to the invention containing at least 1% aluminium, the very high mechanical strength values envisaged are only obtained when the sum of Al+Ti is at least equal to 2.25% by weight.

On the other hand, the titanium very effectively fixes the carbon contained in the steel in the form of the carbide TiC, which makes it possible to avoid the harmful effects of the free carbon as indicated below. Moreover, since the solubility of the carbide TiC is quite low it is possible to precipitate this carbide in a homogeneous manner in the steel during the final phases of the thermomechanical transformation at low temperatures in the austenitic range of the steel: this makes it possible to avoid the embrittling intergranular precipitation of the carbide.

In order to obtain these effects in an optimum manner the titanium content must be between 0.5 and 1.5%, preferably between 0.75 and 1.25%

Cobalt, substituted for nickel in a proportion of 2% by weight of cobalt to 1% of nickel, is advantageous because it makes it possible to stabilise the austenite at the melting temperatures, whilst making it possible to retain solidification of the steel according to the invention by the desired ferritic mode (it very slightly stabilises the austenite at the solidification temperature): in this case the cobalt widens the range of the compositions according to the invention as defined by the relations linking Cr eq and Ni eq. Moreover, whilst stabilising the austenitic structure at the melting temperatures, the substitution of 1% nickel by 2% cobalt makes it possible to record quite clearly the starting point Ms of the martensitic transformation of the steel, as can be deduced from the formula for calculation of Ms.

Finally, the cobalt gives the martensitic structure a stronger capacity for response to the hardening; however, the cobalt does not directly participate in the hardening by precipitation of the phase β-NiAl and does not have the effect of making the nickel ductile. On the contrary, it favours the precipitation of the embrittling phase a σ-FeCr to the detriment of the phase $\mu$-$Fe_7Mo_6$ which can have a hardening effect.

For these two latter reasons the addition of cobalt is limited to 2%, preferably to 0.5% in the restricted range where all the properties of the steel according to the invention can be obtained without utilising the effects of the cobalt.

Tungsten can be added in substitution for molybdenum since it participates more actively in the hardening of the solid solution of martensite, and it is also capable of participating in the precipitation to annealing of the intermetallic phase of type $\mu$-$Fe_7$ (Mo, W)$_6$. Up to 1% can be added to it if the sum Mo+(W/2) does not exceed 3%.

In general, small quantities of certain elements or impurities, metallic, metalloid or non-metallic, can considerably modify the properties of all the alloys.

Phosphorus tends to segregate at the joints of the grains, which reduces the adhesion of these joints and decreases the toughness and the ductility of the steels by intergranular embrittlement. A maximum content of 0.02%, preferably of 0.01%, should not be exceeded in the steel according to the invention.

Sulphur is known to induce substantial embrittlement of high-strength steels in various ways such as intergranular segregation and precipitation of inclusions of sulphides: the objective therefore is to minimise the content thereof in the steel as well as possible, as a function of the available means of production. Very low contents of sulphur are quite readily accessible in the starting materials with conventional refining means. It is therefore easy to respond to the requirement of the steel according to the invention which specifies that the mechanical properties required demand a sulphur content lower than 0.0050%, preferably lower than 0.0010% and ideally lower than 0.0005%, by means of an appropriate choice of the starting materials.

The nitrogen content must also be kept at the lowest value possible with the available means of production, on the one hand in order to obtain the best ductility of the steel, and on the other hand in order to obtain the highest possible fatigue strength limit, in particular since the steel contains the element titanium. In fact, in the presence of titanium nitrogen forms insoluble cubic nitrides TiN which are extremely detrimental due to their form and their physical properties. They constitute systematic triggers of cracking in fatigue.

However, the concentrations of nitrogen which are currently obtained by the industrial vacuum production methods remain relatively high, in particular in the presence of additions of titanium.

Very low nitrogen contents can only be obtained by careful selection of starting materials, in particular ferro-chromium with very low nitrogen contents, which is very costly.

Generally, the industrial vacuum production method makes it possible to obtain residual nitrogen contents between 0.0030 and 0.0100%, typically centred on 0.0050-0.0060% in the case of the steel according to the invention. The best solution for the steel according to the invention is therefore to seek a residual nitrogen content as low as possible, that is to say lower than 0.0060%.

If necessary, and when the application requires exceptional characteristics of fatigue resistance, toughness and/or ductility, nitrogen contents lower than 0.0030% can be sought by the choice of starting materials and of specific methods of production.

Carbon, commonly present in steels, is an undesirable element in the steel according to the invention for several reasons:

- it causes the precipitation of carbides which reduce the ductility and the toughness,
- it fixes chromium in the form of the carbide $M_{23}C_6$, which is easily soluble and of which the precipitation during the various thermal manufacturing cycles is produced partially in the joints of the grains of which the surrounding matrix is thus low in chromium: this mechanism is the source of the very detrimental and well known phenomenon of intergranular corrosion,
- it hardens the martensitic matrix in the state of melting and quenching, which renders it more fragile and in particular more sensitive to "hairline cracks" (superficial cracks which appear during quenching).

For all these reasons, the maximum carbon content of the steel according to the invention is limited to 0.025% at most, preferably 0.0120% at most.

Copper, which is an element found residually in commercial starting materials, must not be present above 0.5%, and preferably a final copper content lower than or equal to 0.25% in the steel according to the invention is recommended. The presence of a greater quantity of copper would unbalance the overall behaviour of the steel: copper easily tends to shift the mode of solidification outside the required range, and unnecessarily lowers the point of transformation Ms.

Manganese and silicon are commonly present in steels, in particular because they are used as deoxidants of the liquid metal during conventional production in a furnace where the liquid steel is in contact with the atmosphere.

Manganese is also used in steels for fixing free sulphur, which is extremely harmful, in the form of manganese sulphides, which are less harmful. Given that the steel according to the invention comprises very low sulphur contents and that it is produced in a vacuum, the elements manganese and silicon are of no use from this point of view, and the contents thereof can be limited to those of the starting materials.

On the other hand, these two elements lower the point of transformation Ms, which reduces all the more the tolerable concentrations of the elements which are favourable to the mechanical and anti-corrosion properties (Ni, Mo, Cr) in order to keep Ms at a sufficiently high level, as it is possible to deduce from the relation between Ms and the chemical composition.

The silicon content must therefore be kept to at most 0.25%, preferably at most 0.10%. The manganese content can also be kept within these same limits.

However, it is also possible to act on the manganese content of the steel according to the invention in order to adjust the compromise between a high resistance to traction and a high toughness which it is desirable to obtain for the envisaged applications. The manganese widens the austenitic loop, and in particular it lowers the temperature Ac1 almost as much as nickel. Furthermore, as it has a lesser effect of lowering Ms than does nickel, it may be advantageous to replace part of the nickel by manganese in order to avoid the presence of δ ferrite and to aid the formation of reverted austenite during the age-hardening. This substitution must, of course, be made whilst complying with the conditions on Cr eq/Ni eq and Ms as seen above. Thus the maximum Mn content can be raised to 3%. In the case of a high manganese content, the mode of production of the steel must be adapted so that this content is controlled well. In particular, it may be preferable not to carry out vacuum treatment subsequent to the principal addition of manganese, as this element tends to evaporate under reduced pressure.

The oxygen present in the steel according to the invention forms oxides which are detrimental to the ductility and to the fatigue resistance. For this reason, it is necessary to keep the concentration thereof at the lowest value possible, that is to say at a maximum of 0.0050%, preferably below 0.0020%, which is permitted by industrial vacuum production means.

Elements which have not been mentioned may be present merely as impurities resulting from production.

The contents given as preferred for the various elements are independent of one another.

The steel according to the invention is typically produced in a vacuum according to traditional industrial practices, for example by means of a vacuum induction furnace or using a double vacuum production phase, for example by production and moulding in vacuum furnace of a first electrode, then by at least one operation of vacuum remelting of this electrode in order to obtain a final ingot. In the case of voluntary addition of manganese, the production of an ingot can comprise a phase of vacuum production of an electrode in an induction furnace followed by a remelting phase according to the electro slag remelting process (ESR); the different methods of remelting ESR or VAR (vacuum arc remelting) can be combined.

The methods of thermomechanical transformation at high temperature, for example forging or rolling, allow easy shaping of the moulded ingots under the usual conditions. These enable all sorts of semi-finished products to be obtained with the steel according to the invention (plates, bars, blocks, forged or drop-forged parts . . . ).

Good structural homogeneity in the semi-finished products is preferably ensured with the aid of a thermal homogenisation treatment between 1200 and 1300° C., carried out before and/or during the range of hot thermomechanical transformations, but not after the last hot transformation in order to prevent subsequent treatments from taking place on semi-finished products in which the grain size is too large.

When the hot thermomechanical transformation operations are completed, the products are then melted at a temperature between 850 and 950° C., then the parts are cooled rapidly to a final temperature lower than or equal to −75° C., without interruption below the point of transformation Ms, possibly by placing an isothermal quenching stage above Ms. As the point Ms is not very high, it is easy to effect quenching with hot oil at T≧Ms. This makes it possible to equalise the temperature in the solid parts and above all to avoid the quenching hairline cracks due to the differential martensitic transformation between the surface of the solid parts and the hot core of the parts. Moreover, starting from a part equalised at a temperature higher than Ms, the martensitic transformation during the cryogenic pass is produced in a continuous manner. Typically the temperature is of the order of −80° C. when this quenching is effected in dry ice. Maintenance at low temperature lasts for a sufficient time to ensure complete cooling in all of the thickness of the parts. It typically lasts at least 4 hours at −80° C.

After return to ambient temperature, the metal consisting of a martensite which is ductile and of low hardness, can optionally be shaped whilst cold and then again melted in order to achieve homogeneous properties.

The final properties of the steel are finally obtained by ageing annealing at temperatures between 450 and 600° C. for a duration in which it is maintained isothermally between 4 and 32 hours as a function of the characteristics required. In fact, the combination of the variables of time and ageing temperature is chosen by considering the following criteria in the range 450-600° C.:

- the maximum resistance attained diminishes when the ageing temperature increases but, vice versa, the values of ductility and of toughness increase,
- the duration of ageing necessary in order to cause hardening increases when the temperature decreases,
- at each temperature level, the resistance passes a maximum for a predetermined duration, which is called the "hardening peak",
- for each level of resistance envisaged, which can be achieved by several combinations of the variables of time and ageing temperature, there is only one time/temperature combination which gives the best resistance/ductility compromise to the steel according to the invention. These optimum conditions correspond to the start of over-ageing of the structure, obtained when the "hardening peak" defined above is exceeded.

A description will now be given of the examples of steels according to the invention and of methods according to the invention which are applied to them, as well as reference examples for comparison with the results obtained.

Table 1 shows the compositions of the steels tested.

TABLE 1

Composition of the steels tested

| | References | | | | Invention | | | | | |
|---|---|---|---|---|---|---|---|---|---|---|
| | A | B | C | D | E | F | G | H | I | J |
| C % | 0.0080 | 0.0040 | 0.013 | <0.0020 | 0.0091 | 0.0028 | 0.0120 | 0.0120 | 0.0044 | 0.0024 |
| Si % | 0.073 | <0.030 | <0.030 | <0.030 | 0.021 | 0.038 | 0.036 | 0.038 | <0.03 | 0.033 |
| Mn % | <0.030 | <0.030 | <0.030 | <0.030 | <0.050 | 0.016 | 0.019 | 0.023 | <0.03 | <0.030 |
| Ni % | 10.71 | 10.96 | 10.46 | 11.83 | 11.16 | 10.58 | 10.85 | 11.84 | 10.95 | 12.47 |
| Cr % | 11.53 | 11.44 | 10.75 | 11.63 | 11.36 | 11.40 | 10.89 | 9.00 | 10.35 | 10.00 |
| Mo % | 2.01 | 2.00 | 3.48 | 2.34 | 1.94 | 1.98 | 2.45 | 2.96 | 2.85 | 2.00 |
| Al % | 1.60 | 1.43 | 1.21 | 1.55 | 1.35 | 1.38 | 1.41 | 1.41 | 1.33 | 1.41 |
| Ti % | 0.322 | 0.605 | 0.321 | 1.00 | 1.03 | 0.961 | 1.02 | 0.842 | 1.22 | 1.09 |
| W % | <0.020 | <0.020 | <0.020 | <0.020 | <0.020 | 0.020 | <0.020 | <0.020 | <0.020 | <0.020 |
| N % | 0.0012 | 0.0027 | 0.0084 | 0.0026 | 0.0056 | 0.0064 | 0.0032 | 0.0029 | 0.0007 | 0.0007 |
| Co % | ≦0.05 | ≦.,05 | ≦0.05 | <0.05 | <0.05 | <0.05 | <0.05 | <0.05 | 0.103 | 0.038 |
| Cu % | <0.020 | <0.020 | <0.020 | <0.020 | <0.020 | <0.020 | <0.020 | <0.020 | <0.020 | <0.020 |
| S % | 0.00027 | 0.0007 | 0.0007 | 0.0002 | 0.0004 | 0.0009 | 0.0006 | 0.0006 | 0.0001 | 0.0001 |
| O % | — | — | — | 0.0004 | 0.0012 | 0.0014 | 0.0009 | 0.0008 | — | 0.0005 |
| Ti % + Al % | 1.922 | 2.035 | 1.531 | 2.55 | 2.38 | 2.341 | 2.43 | 2.252 | 2.55 | 2.50 |
| $M_s$ | 113 | 102 | 111 | 32 | 97 | 131 | 124 | 123 | 127 | 75 |
| Cr eq/Ni eq | 1.06 | 1.01 | 0.99 | 1.01 | 0.98 | 1.05 | 1.02 | 0.87 | 1.01 | 0.85 |

The reference samples have compositions which differ from the invention essentially in their titanium content which is too low (A and C) and/or their sum Ti+Al which is too low (A, B, C) or in their point Ms which is too low because it is lower than 50° C. (D). The sample C also has a molybdenum content which is too high.

These samples were obtained by production of an electrode of 1t (samples A, D, I and J) or 200 kg (the others) in a vacuum furnace, the electrode then being remelted in consumable electrode furnace, and underwent the following thermomechanical treatments:

- homogenisation for 24 hours at 1250° C.;
- forging when they come out of the furnace with a reduction in thickness greater than or equal to 4;
- finishing forging at a trimming rate of at least 2 after heating to 950° C.;
- melting at temperatures of approximately 900° C. for 2 hours, followed by quenching with water and a cryogenic treatment at −80° C. in dry ice for 8 hours (except for sample I where the melting was carried out at 950° C. for 1.5 hours), ageing annealing at 510° C. for 8 hours.

The principal structural and mechanical characteristics of the samples are set out in Table 2.

TABLE 2 structural and mechanical characteristics of the steels tested.

| | References | | | | Invention | | | | | |
|---|---|---|---|---|---|---|---|---|---|---|
| | A | B | C | D | E | F | G | H | I | J |
| Rm (MPa) | 1778 | 1815 | 1690 | 1671 | 1888 | 1896 | 1920 | 1908 | 1947 | 1842 |
| Rp0.2 (MPa) | 1667 | 1710 | 1595 | 1439 | 1763 | 1800 | 1822 | 1795 | 1895 | 1661 |
| Z (%) | 59 | 61 | 61 | 61 | 53 | 56 | 53 | 55 | 50 | 51 |
| KV (J) | 15 | 14 | 35 | 20 | 9/13 | 6/7 | 8/9 | 8/8 | 6 | — |
| A (%) | 10.9 | 10.7 | 10.7 | 11.5 | 9.5 | 9.1 | 9.2 | 9.4 | 9.1 | 11.7 |
| $K_{1c}$ (T-L) (MPa $\sqrt{m}$) | 85 | 70 | 101 | — | — | — | 46 | — | — | 76 |

The steels according to the invention therefore make it possible:

- to obtain the required levels of fracture resistance Rm of more than 1800 MPa, as well as a high yield strength Rp 0.2;
- to maintain a ductility which is not too degraded relative to the reference steels.

The reference steel D, of which only the value of Ms does not conform to the invention, does not reach the desired level of hardening, although its sum Al+Ti fulfils the condition Al+Ti≧2.25. In fact, it contains 16% residual austenite after cryogenic treatment.

Amongst the steels according to the invention, two categories can be distinguished:

- those which have a higher resistance to corrosion (high chromium and molybdenum), but which have a greater fragility because the nickel content is necessarily lower if it is wished to comply with the condition on Ms: E, F, G, H, I relate to this category
- those which offer a better ductility than the preceding ones because their nickel content is high, but in which the resistance to corrosion is less because their chromium and molybdenum contents are necessarily limited so that the condition concerning Ms is met: J relates to this category.

The invention claimed is:

1. Martensitic stainless steel, characterised in that its composition is, in percentages by weight:

9%≦Cr≦13%
1.5%≦Mo≦3%
8%≦Ni≦14%
1%≦Al≦2%
0.5%≦Ti≦1.5% with Al+Ti≧2.25%
traces≦Co≦2%
traces≦W≦1% with Mo+(W/2)≦3%
traces≦P≦0.02%
traces≦S≦0.0050%
traces≦N≦0.0060%
traces≦C≦0.025%
traces≦Cu≦0.5%
traces≦Mn≦3%
traces≦Si≦0.25%
traces≦O≦0.0050% and is such that:

$$M_S(°\,C.)=1302-42Cr-63Ni-30Mo+20Al-15W-33Mn-28Si-30Cu-13Co+10Ti\geqq 50$$

$$Cr\ eq/Ni\ eq\leqq 1.05$$

with $Cr\ eq\ (\%)=Cr+2Si+Mo+1.5Ti+5.5Al+0.6W$ $Ni\ eq\ (\%)=2Ni+0.5Mn+30C+25N+Co+0.3Cu.$

2. Steel according to claim 1, characterised in that 10%≦Cr≦11.75%.

3. Steel according to claim 1, characterised in that 2%≦Mo≦3%.

4. Steel according to claim 1, characterised in that 10.5%≦Ni≦12.5%.

5. Steel according to claim 1, characterised in that 1.2%≦Al≦1.6%.

6. Steel according to claim 1, characterised in that 0.75%≦Ti≦1.25%.

7. Steel according to claim 1, characterised in that traces≦Co≦0.5%.

8. Steel according to claim 1, characterised in that traces≦P≦0.01%.

9. Steel according to claim 1, characterised in that traces≦S≦0.0010%.

10. Steel according to claim 1, characterised in that traces≦S≦0.0005%.

11. Steel according to claim 1, characterised in that traces≦N≦0.0030%.

12. Steel according to claim 1, characterised in that traces≦C≦0.0120%.

13. Steel according to claim 1, characterised in that traces≦Cu≦0.25%.

14. Steel according to claim 1, characterised in that traces≦Si≦0.25%.

15. Steel according to claim 1, characterised in that traces≦Si≦0.10%.

16. Steel according to claim 1, characterised in that traces≦Mn≦0.25%.

17. Steel according to claim 16, characterised in that traces≦Mn≦0.10%.

18. Steel according to claim 1, characterised in that traces≦O≦0.0020%.

19. Method of making a mechanical part from steel with high mechanical strength and resistance to corrosion, characterised in that:

- producing a semi-finished product by preparing then transforming a hot ingot having a composition according to claim 1;

carrying out a heat treatment of melting said semi-finished product at a temperature between 850 and 950° C., immediately followed by a cryogenic treatment of rapid cooling to a temperature below or equal to −75° C. without interruption below the point of transformation Ms and during a sufficient time in order to ensure complete cooling throughout the thickness of the part;

aging annealing is carried out between 450 and 600° C. for an isothermal maintenance period of 4 to 32 hours.

20. Method according to claim 19, characterised in that the said cryogenic treatment is quenching with dry ice.

21. Method according to claim 19, characterised in that the said cryogenic treatment is carried out at a temperature of −80° C. for at least 4 hours.

22. Method according to claim 19, characterised in that, between the said melting treatment and the said cryogenic treatment, isothermal quenching is carried out at a temperature higher than the point of transformation Ms.

23. Method according to claim 19, characterised in that, after the cryogenic treatment and before the ageing annealing, cold shaping and a thermal melting treatment are carried out.

24. Method according to claim 20, characterised in that at least one thermal homogenisation treatment between 1200 and 1300° C. is carried out for at least 24 hours on the ingot or during the transformation of the ingot into the semi-finished product, but before the last of the hot transformations.

25. Mechanical part made from steel with high resistance to corrosion and high mechanical strength, characterised in that it has been obtained by the method according to claim 19.

26. Mechanical part according to claim 25, characterised in that it is a casing of an aircraft landing gear.

* * * * *